United States Patent [19]

Hatayama et al.

[11] Patent Number: 4,700,025

[45] Date of Patent: Oct. 13, 1987

[54] TRANSPARENT TOUCH-SENSITIVE PANEL

[75] Inventors: Masato Hatayama; Satoru Matsumora, both of Miyagi, Japan

[73] Assignee: Alps Electric Co., Ltd., Japan

[21] Appl. No.: 13,369

[22] Filed: Feb. 11, 1987

[30] Foreign Application Priority Data

May 23, 1986 [JP] Japan ..... 61-76929[U]

[51] Int. Cl.[4] ..... H01H 9/02

[52] U.S. Cl. ..... 200/5 A; 200/159 B; 200/311; 200/314

[58] Field of Search ..... 200/5 A, 159 B, 314, 200/311

[56] References Cited

U.S. PATENT DOCUMENTS 3,617,666 4/1970 Braue ..... 200/86
4,197,439 4/1980 Mecklenburg et al. ..... 200/5 A
4,558,190 10/1985 Saito ..... 200/5 A

*Primary Examiner*—A. D. Pellinen
*Assistant Examiner*—Morris Ginsburg
*Attorney, Agent, or Firm*—Guy W. Shoup

[57] ABSTRACT

A transparent touch-sensitive panel comprising a transparent touch-sensitive switch consisting of an upper plate, a lower plate, and an insulating spacer. A transparent board has an outer peripheral portion to which the lower plate is bonded via a transparent adhesive layer. A visual display such as a liquid-crystal display is mounted on the underside of the board. An uneven surface is formed on one of the upper surface of the board and the lower surface of the lower plate which are disposed opposite to each other and through which the light emanating from the visual display is transmitted.

3 Claims, 4 Drawing Figures

TRANSPARENT TOUCH-SENSITIVE PANEL

FIELD OF THE INVENTION

The present invention relates to a touch-sensitive panel comprising a transparent touch-sensitive switch, a transparent board, and a visual display.

BACKGROUND OF THE INVENTION

A conventional touch-sensitive panel of this kind is shown in FIGS. 3 and 4. This panel has a transparent upper plate 1D, made of a flexible, insulating resin, a lower plate 1A also made of a flexible, insulating resin, and transparent electrodes 1B and 1C formed on the lower plate 1A and the upper plate 1D, respectively. The plates 1A and 1D are disposed opposite to each other such that an insulating spacer 1F is sandwiched between them. Thus, a transparent touch-sensitive switch A is formed. This switch A is held on a transparent board 2 which is totally bonded to the lower plate 1A via a layer 3 of transparent adhesive in an airtight manner. A visual display 4, such as a liquid-crystal display or electro-luminescent display, is disposed on the underside of the board 2. Spacers 1E are arranged in the form of a matrix of dots. When the upper plate 1D is depressed, the electrode 1C comes into contact with the opposite electrode 1B, making the circuit of the switch A. At the same time, the touched point is momentarily displayed on the visual display 4, or it is continued to be displayed.

It is difficult to make smooth the surface of the transparent adhesive layer 3 of the conventional panel. Further, since substantially the whole surface of the lower plate 1A is held to the board 2 via this transparent adhesive layer 3, if foreign matter intrudes into the panel during the assembly, then the foreign matter will be held by the adhesive layer 3. As a result, the image that should be seen through the touch-sensitive switch A is distorted or made invisible.

SUMMARY OF THE INVENTION

In view of the foregoing difficulties with the conventional panel, it is an object of the present invention to provide a transparent touch-sensitive panel having a touch-sensitive switch which neither distorts nor blocks the image that should be seen through the switch.

The above object is achieved by a touch-sensitive panel comprising: an upper plate; a lower plate disposed opposite to the upper plate; a transparent board having an outer peripheral portion to which the lower plate is bonded via a transparent adhesive layer; a visual display; and an uneven surface formed on one of the two opposite surfaces of the lower plate and the board which pass the light emanating from the visual display.

In the panel constructed as described above, any transparent adhesive layer does not exist in the space between the lower plate and the board, the space passing the light emanating from the visual display. Therefore, the image on the visual display which is seen through the touch-sensitive switch is neither distorted nor blocked. Additionally, the uneven surface formed on one of the two opposite surfaces of the lower plate and the board prevents Newton's rings from forming, although an air layer exists between the lower plate and the board.

Other objects and features of the invention will appear in the course of the description thereof which follows.

DETAILED DESCRIPTION OF THE INVENTION

Figure 1:
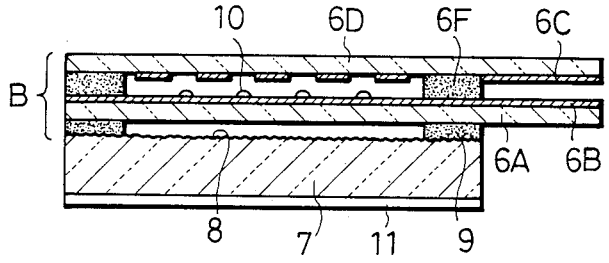
FIG. 1 is a cross-sectional view of a transparent touch-sensitive panel according to the present invention.

Referring to FIG. 1, there is shown a transparent touch-sensitive panel embodying the concept of the invention. This panel comprises a transparent touch-sensitive switch B and a transparent board 7 on which the switch B is held. The switch B comprises an upper plate 6D made of a transparent film of a plastic, such as polyester or polyethersulfone, a lower plate 6A that is similar in material to the upper plate 6D, and transparent electrodes 6B and 6C formed on the lower plate 6A and the upper plate 6D, respectively. The electrically conducting electrodes 6B and 6C are made from a transparent oxide of indium, zinc, or the like. These two plates 6A and 6D are disposed opposite to each other with an insulating spacer 6F therebetween. The board 7 is made of a transparent plastic, such as acrylic resin or polycarbonate, or a transparent glass. The surface of the board 7 which faces the lower plate 6A is coated with transparent acrylic resin to form an uneven surface 8. As a specific example, protrusions of 1 $\mu$m high are formed on the uneven surface 8 at a density of 1000/cm$^2$. The adhesive layer 9 has an outer peripheral portion to which the lower plate 6A, is bonded via a transparent adhesive layer 9. Spacers 10 are arranged in the form of a matrix of dots. A visual display 11 is disposed on the underside of the board 7.

When the upper plate 6D of the touch-sensitive panel is depressed, the electrode 6C comes into contact with the opposite electrode 6B to make the circuit of the switch B. Simultaneously, the touched point is momentarily displayed on the visual display 11, or it is continued to be displayed.

In the above example, the uneven surface 8 has 1000 protrusions of 1 $\mu$m high per cm$^2$. The image on the visual display 11 can be perceived without producing Newton's rings or impairing the appearance as long as the height of the protrusions ranges from 0.1 $\mu$m to 5 $\mu$m and the density ranges from 100/cm$^2$ to 10,000/cm$^2$.

In the example described above, any transparent adhesive layer, such as the adhesive layer 9 of the conventional panel, does not exist in the path through which the light coming from the visual display 11 is transmitted. Consequently, it is unlikely that foreign matter is introduced and fixed, which would heretofore have been caused by the transparent adhesive layer 9. Hence, the image on the visual display 11 that is seen through the touch-sensitive switch B is neither distorted nor blocked.

Since the lower plate 6A is bonded to the outer peripheral portion of the board 7 via the transparent adhesive layer 9, when the upper plate 6D is depressed, it bends downward to equivalently form a convex lens. This might lead one to consider the possibility that the light waves reflected off the surface of the lower plate 6A interfere with the light waves that are reflected off the surface of the board 7 after being transmitted through the lower plate 6A, giving rise to Newton's rings. However, this phenomenon does not take place, because the uneven surface 8 formed on the board 7 as shown in FIG. 1 reflects light irregularly.

Figure 2:
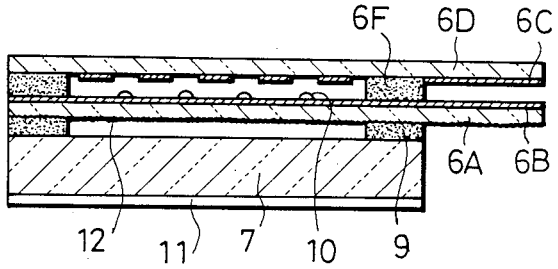
FIG. 2 is a cross-sectional view of another transparent touch-sensitive panel according to the invention.
Figure 3:
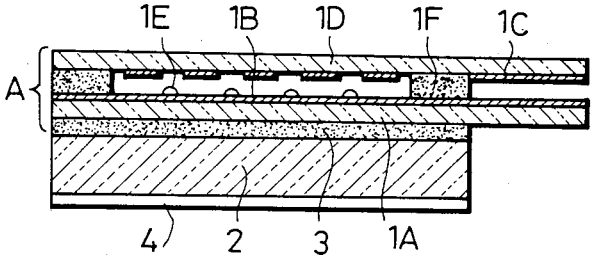
Fig. 3 PRIOR ART
FIG. 3 is a cross-sectional view of a conventional touch-sensitive panel.
Figure 4:
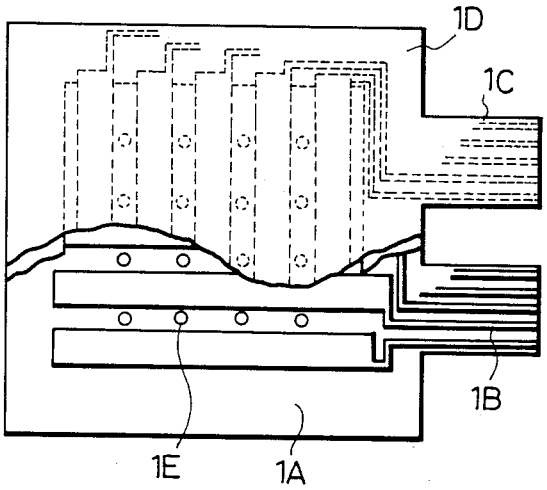
Fig. 4 PRIOR ART
FIG. 4 is a top view of the panel shown in FIG. 3.

Referring next to FIG. 2, there is shown another touch-sensitive panel according to the invention. This panel is similar to the panel already described in connection with FIG. 1 except that an uneven surface 12 is formed on the underside of the lower plate 6A. The light reflected off the surface of the board 7 is reflected diffusely, whereby the formation of Newton's rings can be avoided in the same manner as in the panel shown in FIG. 1.

In the above example shown in FIG. 1, the board 7 is coated with transparent acrylic resin to form the uneven surface 8. The board may also be coated with other transparent resin. Further, a transparent or semi-transparent resin may be formed by a mechanical method such as sandblasting or transfer process during the molding. Furthermore, the number of the protrusions and the height already described may be altered, depending on the optical characteristics of the material, the physical shape, and the distance between the uneven surface 8 and the visual display 11.

In the novel touch-sensitive panel, no foreign matter is introduced or fixed in the light path, i.e., between the lower plate and the board. Therefore, the image on the visual display which is seen through the touch-sensitive switch is neither distorted nor blocked. The uneven surface formed on one of the two opposite surfaces of the lower plate and the transparent board prevents the formation of Newton's rings which would otherwise be produced by the air layer between the lower plate and the transparent board.

What is claimed is:

1. A transparent touch-sensitive panel, comprising:

an upper plate on which transparent electrodes are formed;

a lower plate on which transparent electrodes are formed so as to face the electrodes on the upper plate, the lower plate being spaced a given distance from the upper plate by means of an insulating spacer, the upper and lower plates forming a transparent touch-sensitive switch;

a transparent board having an outer peripheral portion to which the lower plate is bonded via a transparent adhesive layer;

a visual display placed on the board; and an uneven surface formed on one of the two opposite surfaces of the lower plate and the board which pass the light emanating from the visual display.

2. The transparent touch-sensitive panel of claim 1, wherein said uneven surface has 100 to 10,000 protrusions of 0.5 to 5 $\mu$m high per $cm^2$.

3. The transparent touch-sensitive panel of claim 1, wherein said adhesive layer by which the lower plate is bonded to the board is made of a transparent adhesive.

* * * * *